United States Patent [19]

Juvinall et al.

[11] 4,002,777

[45] Jan. 11, 1977

[54] METHOD OF DEPOSITING ELECTROSTATICALLY CHARGED LIQUID COATING MATERIAL

[75] Inventors: James W. Juvinall, Sylvania Township, Lucas County; Erhard Kock, Toledo, both of Ohio

[73] Assignee: Ransburg Corporation, Indianapolis, Ind.

[22] Filed: Sept. 2, 1969

[21] Appl. No.: 849,526

Related U.S. Application Data

[63] Continuation of Ser. No. 677,981, Oct. 25, 1967, abandoned, which is a continuation-in-part of Ser. No. 624,400, March 20, 1967, abandoned.

[52] U.S. Cl. ..... 427/27; 118/621; 239/3; 427/30

[51] Int. Cl.[2] ..... B05D 1/06

[58] Field of Search ..... 117/93.4, 93.41, 93.42, 117/93.43, 93.44; 118/621, 626; 239/3, 15

[56] References Cited

UNITED STATES PATENTS

| | | | |
|---|---|---|---|
| 2,782,074 | 2/1957 | Sedlacsik | 117/93.4 |
| 2,826,513 | 3/1958 | Blanchard | 117/93.42 |
| 3,246,844 | 4/1966 | Lehman et al. | 239/15 |
| 3,296,015 | 1/1967 | Juvinall et al. | 117/93.44 |

FOREIGN PATENTS OR APPLICATIONS

| | | | |
|---|---|---|---|
| 697,701 | 9/1953 | United Kingdom | 117/93.4 |

*Primary Examiner*—John Newsome
*Attorney, Agent, or Firm*—Merrill N. Johnson

[57] ABSTRACT

Electrostatic deposition of air atomized liquid coating materials by adjusting the conductivity of the coating material and the voltage applied thereto so that virtually no air ionization occurs. Thus, essentially all of the current reaching the object to be coated is carried by the sprayed material thus minimizing the charge build-up on the subject, and eliminating charge accumulation on ungrounded objects out of the spray zone.

13 Claims, 8 Drawing Figures

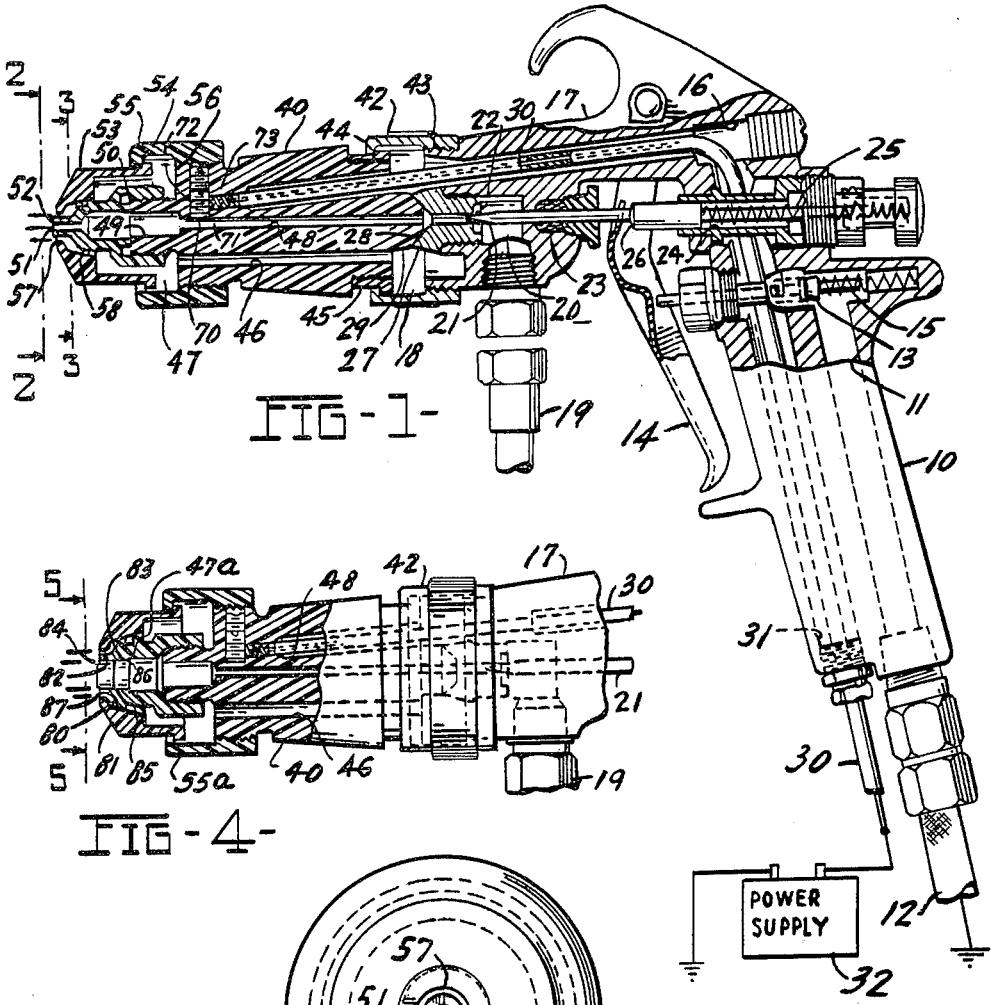
FIG-1-
FIG-4-
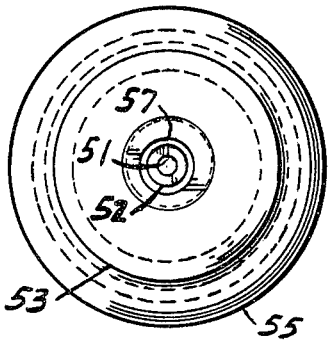
FIG-2-
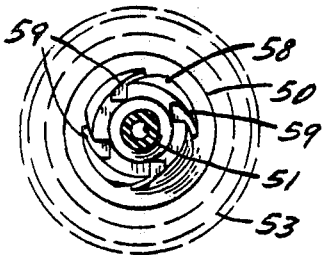
FIG-3-
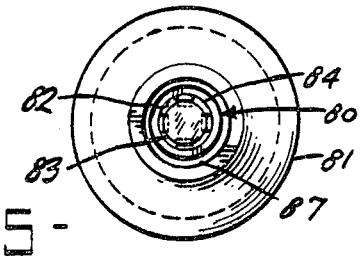
FIG-5-

METHOD OF DEPOSITING ELECTROSTATICALLY CHARGED LIQUID COATING MATERIAL

This is a continuation of application Ser. No. 677,981, filed Oct. 25, 1967, now abandoned, which application in turn was a continuation-in-part of application Ser. No. 624,400, filed March 20, 1967, now abandoned.

The invention encompasses a method for effecting electrostatic charging and deposition of coating material particles atomized by compressed air without significant air ionization. This invention is particularly advantageous when used with the apparatus and method of U.S. Pat. No. 3,048,498. Under these circumstances electrostatic charging and deposition of an air atomized spray in an electrostatic system can be carried out so that an operator may approach and touch the electrostatic spray guns and ungrounded objects near the electrostatic spray guns and not in the path of the spray will not accumulate significant electrical charge.

BRIEF DESCRIPTION OF THE DRAWINGS

FIG. 1 is a horizontal cross-sectional view, with parts in full, showing one form of spray gun capable of carrying out the method of the present invention;

FIG. 2 is a section on line 2—2 of FIG. 1;

FIG. 3 is a section on line 3—3 of FIG. 1;

FIG. 4 is a fragmentary view, with parts in section, showing an alternate form of nozzle configuration;

FIG. 5 is a front elevational view taken on line 5—5 of FIG. 4;

Figure 6:
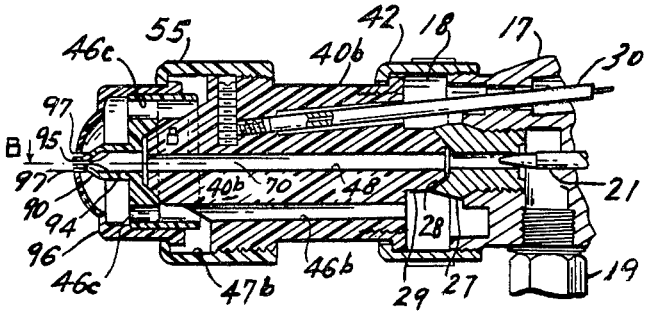
FIG. 6 is a central vertical sectional view, with parts in full, of a portion of an additional modification of a spray gun capable of carrying out the method of the present invention, and which will produce a fan-shaped pattern.

The drawings show spray guns capable of carrying out the method of the present invention with three different forms of nozzles and caps, two of which will result in a round spray pattern, and one of which will result in a fan-shaped spray form. Each pattern has its desirable features. For example, if a hand spray gun is to be used to coat objects that are generally flat, or at least have flat panel-like areas, some operators will prefer the fan-shaped spray. For open objects such as metal furniture legs or bicycle frames, most operators would prefer that the pattern be round.

FIG. 1 of the drawings shows a preferred form of spray gun which results in a round spray pattern. This gun includes generally a handle portion 10 having an internal passage 11 to which an air hose 12 may be connected. Passage 11 is controlled by a valve 13 operated to its open position by a trigger 14 and pressed by a suitable spring 15 to closed position. Atomizing air enters the gun through passage 11, past valve 13, and into an internal passage 16 in a gun body designated generally 17.

The air passage 16 terminates in an annular air chamber 18 at the front of the gun body 17.

Coating material is introduced into the gun body 17 through a hose 19 which leads to a central passage 20 in the gun body. A needle valve 21 cooperates with a seat 22 to control the flow of coating material through the gun, and the stem of the valve 21 extends through a conventional packing 23 into a rearwardly disposed chamber 24 in which an adjustable spring 25 is contained which urges the coating material valve to closed position. A shoulder 26 on the valve stem is engaged by the trigger 14 to open the valve against the force of spring 25 in the usual manner. When the valve 21 is open, coating material flows forwardly through an insert 27 having a tapered front end 28 against which a correspondingly tapered barrel portion 28 seats when a barrel and nozzle assembly is assembled on the gun body 17.

Charging voltage is brought into the spray gun in any suitable manner. A cable 30 is provided which extends into a bore 31 in the gun handle 10 and runs through the atomizing air passage 16. The bore 31 is, of course, sealed at its entrance end to prevent the escape of atomizing air when the valve 13 is open. The charging voltage cable 30 is connected to any appropriate power supply 32, one side of which is grounded, and the metallic gun body 17 is also held at ground potential in any suitable manner, as by the use of a conventional ground wire in the air hose 12. The ground wire is normally a part of the braided layer of the air hose and is not specifically shown in the drawings, except by the diagrammatic indication of a ground connection where the air hose is broken off in FIG. 1.

The first of the three nozzles disclosed in the drawings, and shown in section in FIG. 1, includes a barrel 40 of insulating material through which appropriate air and coating material passages are drilled as hereinafter described. The barrel is held against the metallic gun body 17 by a gland nut 42 which is preferably metallic and which engages threads 43 on the gun body and a shoulder 44 on an adapter 45 that is threaded over the rear end of the body of the barrel 40. The tapered portion 28 formed on the barrel 40 is held in mating and sealing relationship with the insert 27 by the gland nut 42. The annular air chamber 18 at the front of the gun body 17 opens to the interior of the gland nut 42 and to an atomizing air passage 46 extending axially forward through the barrel 40 to an annular air chamber 47. The gland nut 42 acting with the gun body 17 serves as a field intensifying electrode, but there is no current flow through the air or over the barrel surface from the front of the gun to the gland nut, and there is no ionization caused thereby.

A coating material passage 48 runs forwardly through the barrel from the insert 27 and barrel portion 29. The length and dimensions of this passage will be discussed hereinafter. The passage 48 merges into an enlargement 49 over which a fluid tip 50 is threadedly received. The fluid tip 50 is a tubular member having a reduced coating material orifice 51 in a nozzle extension 52. The extension 52 is preferably cylindrical with the axis of the cylinder being on the axis of the coating material passage 48.

An air cap 53 surrounds the fluid tip 50 and is provided with a shoulder 54 engaged by a gland nut 55 the end of which is threaded over threads 56 on the barrel 40 to hold the interior of the air cap snugly against the outside of the fluid tip.

At its forward end the air cap forms an annular air orifice 57 around the coating material orifice 51 and the axial dimension of the wall forming the air orifice 57 is sufficient that a cylindrical passage is formed between the exterior of the fluid tip and the interior surface of the air cap.

A most important aspect of this form of the apparatus used to carry out the present invention is that the forward velocity of atomized coating material is reduced. One method of accomplishing this is by imparting a rapid whirling movement to the airstream prior to its emergence from the air orifice 57. This whirling air movement is set up by a conical flange extension 58 from the fluid tip in which angular slots 59 are cut as shown best in FIG. 3. The exterior of the conical flange extension 58 of the fluid tip 50 mates with a similar conical surface on the interior of the air cap to form the tops of the angularly directed slots 59 in the flange extension. By imparting a rapid whirling movement to the air prior to, during or immediately after its emergence from the air orifice 57 atomization occurs close to the end of the fluid tip orifice 51 and the spray has a relatively low forward velocity in the direction of the object to be coated. It has been found that by this expedient the diameter of the pattern on the target is greatly enlarged and is more usable than if the whirling component of motion of the air is omitted.

Charging voltage is applied to the paint stream from the cable 30 by a charging button 70 which is disposed at the bottom of a radial passage 71 containing a metallic connector element 72. Contact between the end of the cable 30 and the contact element 72 is made in any suitable manner as by a spring 73. Electrical contact to the paint is thus established by conductivity through its direct contact with the button 70. After the connector element is placed in passage 71 the passage may be sealed by an insulating material. A preferred distance between the charging button 70 and the material discharge orifice is that distance which is greater than the sparking distance in air at the maximum operating voltage.

Since the full charging voltage appears at the button 70, and the fluid needle valve 21 is grounded, the resistance of the paint column in the passage 48 must be high enough that there is no undue loss of charging voltage from a power supply having a relatively high internal impedance by reason of current dissipation through the paint column back to the grounded fluid needle valve 21. As hereinafter noted, it is preferred that the current flow through the paint column be held to less than a current of such magnitude as will cause overheating of the nozzle elements and undue loss of voltage at the charging button 70.

The nozzle shown in FIGS. 4 and 5 of the drawings differs from the nozzle shown and described in connection with FIGS. 1–3 only in that the fluid tip and air cap portions have been changed. The fluid tip and air cap are designated 80 and 81 respectively and are held in place with relation to the barrel 40 by a gland nut 55*a*. The fluid tip 80 has a somewhat larger central passage 82 at its exit end in which a fluid directing insert 83 is located to cooperate with the wall of the fluid passage 82 to form an annular discharge orifice 84, preferably about .015 inch wide. The insert 83 has a fluted rear portion to center the insert in the fluid passage and still permit the coating material to flow to the annular discharge orifice 84. The insert 83 is preferably made of the same insulating material as the remainder of the nozzle elements.

As in the previous form of the apparatus the fluid tip 80 is provided with a flange extension 85 having angular slots 86 cut therein to impart the same whirling motion to the air from the air chamber 47*a* and results in the same diffusion of the air. The air cap 81 is, of course, provided with an enlarged air discharge orifice to accommodate the enlarged fluid tip. The air discharge orifice is designated 87 and is annular in form. Again, the axial extent of the surface of the air cap that cooperates with the exterior of the fluid tip to form the air orifice 87 is sufficient to form a forwardly directed cylindrical air passage. The annular fluid discharge orifice 84 and the concentric annular air orifice of this form of the invention give a somewhat more uniform and somewhat enlarged circular pattern to the charged spray particles.

Figure 7:
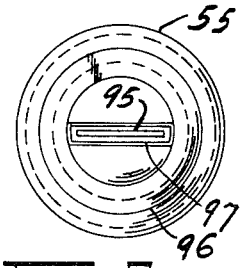
FIG. 7 is a front elevational view of the end of the spray gun shown in FIG. 6.
Figure 8:
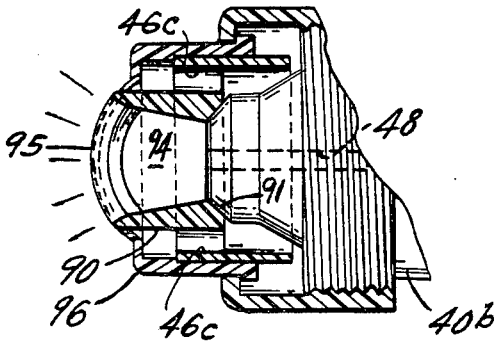
FIG. 8 is an enlarged sectional view taken on line 8—8 of FIG. 6.

The nozzle shown in FIGS. 6, 7 and 8 is an adaptation of that shown and described in Watanabe U.S. Pat. No. 3,195,819, and is used when the desired spray pattern is elliptical or fanshaped. The fluid tip of the nozzle, designated 90, is a plastic body having a seat 91 against a tapered end surface of the barrel 40*b*. The tip is provided with a central fluid passage from the end of the passage 48 in the nozzle body into a chamber 94 which terminates in a narrow arcuate slot 95 from which the fluid issues as a thin film. An air cap 96 receives air from the air passage 46*b* and a series of holes 46*c* in the body of the fluid tip.

At the front end of the gun the air cap 96 is provided with a partially spherical surface having a radius equal to the radius of the arcuate slot 95 in the fluid tip to form slot-like atomizing air passages 97 adjacent the fluid discharge passage on each side thereof. Because of the elongated and arcuate configuration of the air slots the atomizing airstreams are diffused. The air from the arcuate slot-like atomizing air passages 97 interacts with the coating material issuing from the arcuate fluid discharge slot 95 very close to the front of the spray cap and the forward velocity of the coating material particles has been found to be quite low because of the diffusion and the coating efficiency of a spray gun embodying this cap quite high.

Electrical contact to the coating material in this form is again made by contact with the metallic button 70 extending into the central fluid passage 48.

All three of the nozzles so far described will fit the same barrel 40 and the selection of the nozzles will be made by the operator on the basis of the pattern desired.

The method of the present invention is carried out by any of the apparatuses above-described. The preferred operating voltage imposed on the charging button 70 varies between about 12 kv. and about 40 kv. depending on the resistivity of the paint being sprayed. The voltage is preferably positive with respect to the grounded article being coated. At these voltages there is no air ionization at the discharge orifice and in the absence of sprayed paint the current flow to a grounded object at any normal spraying distance is zero. If the spray gun were to be laid on a grounded metal table, the current flow might be measured as high as 0.03 microamperes, assuming that the discharge orifice comes about ¾ inch from the grounded surface and that the fluid passage 48 is filled with paint. It will be appreciated, however, that under no circumstances would the spraying distance be ¾ inch or 1 inch from the end of the gun. A normal spraying distance for a hand gun might be considered to be 8 inches and for an automatic gun either 8 inches or 10 inches. Under conditions where spraying is conducted in a booth where the safety requirements are less rigorous, an air-borne current of 5 percent of the total current from the front of the gun may be tolerated and the charging voltage raised accordingly to as much as 40 kv. with some measurable increase in transfer efficiency.

The present method also includes adjusting the resistivity of the coating material to fall within the range of about 0.3 to about 300 megohm-centimeters. Coating material adjusted to this resistivity will accept a satisfactory charge from the electrode 70. Measuring the current flow from a grounded target is a direct measurement of particle charge because of the absence of any air-borne current. It has been found that a satisfactory particle charge consistent with adequate safety for coating materials of the above range of resistivity will be achieved if a voltage supply having such an internal impedance that the voltages hereinafter tabulated in Example 3 will result with the use of paints of the resistivities noted, the length of the paint column being held constant.

Paint resistivity (or conductivity) may be measured by applying a voltage to one end of a paint column 6 inches long and ¼ inch in diameter and grounding the opposite end of the column through a microammeter. Voltage normally used may be 20 kv., but is arbitrarily reduced if the current flow exceeds about 400 microamperes. In this apparatus: paint resistivity (in megohm-centimeters)

$$\text{paint resistivity (in megohm-centimeters)} = \frac{20.8 \times E \text{ (in kv.)}}{i \text{ (in microamperes)}}.$$

Many commercial paints, measured as above described, will be found to have volume resistivities that are higher than are usable with the present invention. The volume resistivity of such paints can be reduced by the addition of a highly polar solvent in relatively small quantities. Methanol is a common solvent that is highly polar. The addition of methanol in quantities of from 1 percent to 5 percent of the total volume of the paint will usually adjust the volume resistivity into the desired range even of the most highly resistive commercial paints. The polar solvent used must, of course, be compatible with other solvents in the paint system.

Inasmuch as the current to the work or target object is borne almost entirely (upwards of 99 percent) by the paint particles, the charge on the paint particles in microcoulombs per gram may be read almost directly as a function of the current in microamperes flowing from the target to ground. (1 ampere = 1 coulomb per second) Thus the comparison of the suitability of various coating materials, and the efficiencies of various nozzle configurations may be judged very rapidly merely by reading target current. In general, it may be stated that the higher the charge on a particle the better will be the deposition efficiency of the system. We have found that with coating materials of optimum resistivity and with all other conditions arranged for optimum transfer efficiency as hereinafter measured, the current flow from the target to ground indicates a specific charge of about 1.3 to 1.4 microcoulombs per gram of wet paint. This specific charge was obtained with a charging voltage of +32 kv., a paint flow of 150 grams per minute and other parameters that will be hereinafter defined. While there appears to be a slight increase in efficiency as the voltage increases, the maximum voltage usable with the present invention is that at which air ionization occurs. Since there are always ionized particles in the air there will always be some migration of these naturally existing air ions between the spray gun and the work whenever an electrostatic field is set up but this ion migration results in an immeasurably low current. The maximum charging voltage may be selected by filling the spray gun with paint of the desired conductivity, but not spraying, and, at a spacing of 8 inches from a metal target, increasing the voltage until there is the slightest deflection from zero of a microammeter having a full scale deflection of one microampere interposed between the target and ground.

There being essentially no air ionization under spraying conditions any object that is outside the spray zone will not become charged. With other known systems where air ionization occurs, ungrounded objects in the vicinity of the spray gun will rapidly accumulate an electrostatic charge, the extent of the charge being determined by the proximity of the article, its configuration and size, the degree of insulation from ground and, of course, the space current flowing to it from the highly charged spray gun. Total air-borne currents in excess of 50 microamperes are not at all uncommon. Such ungrounded objects may be solvent containers or the like placed on insulated platforms such as wooden platforms or metal dollies having plastic rollers. The accumulated charge on these objects may, if suddenly discharged, create a spark of an intensity sufficient to start a fire or of an intensity sufficient to impart a substantial and disagreeable shock to an operator. Similarly, an operator insulated from ground by rubber soled shoes, for example, may himself become charged and if he subsequently touches a grounded object the discharge of the energy accumulated in his body may be very disagreeable.

Because of the resistance of the paint column disposed between the charging button 70 and the paint discharge orifice and the voltage limitation mentioned, it is safe for the operator to touch the front of the gun at any time. The spray gun is thus inherently safe in the hands of the operator.

Examples of the practice of the present method are as follows:

1. A spray gun of the configuration shown in FIG. 1 was used. This gun has a coating material orifice of a diameter of 0.086 inch and an annular atomizing air orifice 0.016 inch in width. The air flow was adjusted to give satisfactory atomization (at 4 SCFM in the gun tested) and passed through angular slots to give a whirling movement thereto. Gun to target distance was 8 inches and the target consisted of 1 inch diameter foil wrapped rods on 3 inch centers. The foils were grounded through a microammeter to read total current reaching the target. Applied voltage was −24 kv. Paint resistivity was varied from about 0.17 megohm-centimeters to 42 megohm-centimeters. An optimum value of resistivity was found to be about 0.55 megohmcentimeters. The coating material was a standard baking enamel diluted with a mixture of methyl isobutyl ketone and varying percentages of methanol to a viscosity of 21 sec. Zahn No. 2 cup. Methanol was used as a highly polar solvent to adjust the electrical resistivity of the paint as above noted. Current to target in the absence of sprayed paint was zero (less than 0.001 microamperes).

2. With a spray gun as shown in FIGS. 4 and 5 in which the fluid orifice is annular, other conditions as above, somewhat higher efficiencies were obtained.

With this gun, voltage variation tests indicated satisfactory operation from +12 kv. with paint resistivity of 1.3 megohm-centimeters to +40 kv. with higher resistivity paint and a maximum usable resistivity consistent with good transfer efficiency of about 300 megohm-centimeters. Optimum results were obtained with a paint resistivity of 15 to 25 megohm-centimeters and an applied voltage of 32 or 33 kv. positive. Current to target in the absence of sprayed paint was zero (less than 0.001 microamperes).

3. Beginning with a paint that is normally very highly resistive (over 1000 megohm-centimeters), methanol was added in an amount sufficient to bring the resistivity of the paint to varying levels as indicated below. With the spray gun having the annular discharge orifice shown in FIG. 4, with a distance between the discharge orifice and the charging button of nearly 3 inches, the charging button being disposed in a portion of the paint column ¼ inch in diameter and about 2½ inches from the closest grounded part of the gun. The results may be summarized as follows:

| ELECTRODE VOLTAGE (kv) | PAINT RESISTIVITY (megohm-cm.) | TRANSFER EFFICIENCY (foil-wrapped rods) |
|---|---|---|
| +40 | 300 | 50 percent |
| +39 | 150 | 60 percent |
| +37 | 60 | 70 percent |
| +32 | 15 | 75 percent |
| +24 | 5 | 70 percent |
| +17 | 2.5 | 63 percent |
| +12 | 1.5 | 50 percent |

4. With a spray gun as shown in FIGS. 6 and 7 with the slot-type orifices, other conditions as above, except for increasing the air flow to 6 SCFM for satisfactory atomization, paint resistivity-efficiency tests were run and the results were similar to those of the first example set forth above. It was found that at −24 kv. the most satisfactory test results were obtained with a paint resistivity of 1.4 megohm-centimeters.

What we claim is:

1. In a method of depositing liquid coating material on an article in a system in which coating material particles are formed from a thin stream of a liquid body by mechanical force derived from a stream of atomizing air, and in which the liquid body is electrically charged, the improvement comprising the step of adjusting the resistivity of the coating material to be between 0.3 and 300 megohm-centimeters and charging the liquid body to such voltage that at least 95 percent of the current carried to the article is borne by the charged coating material particles and not more than 5 percent of the current is air-borne.

2. The method of depositing liquid coating material on an article in accordance with claim 1 in which the resistivity of the coating material lies between 2.5 and 150 megohm-centimeters.

3. The method of depositing liquid coating material on an article in accordance with claim 1 in which the voltage applied to the liquid body lies between 12 and 40 kilovolts.

4. The method of depositing liquid coating material on an article in accordance with claim 1 in which the resistivity of the coating material lies between 0.3 and 300 megohm-centimeters and the voltage imposed thereon lies between 12 kv. and 40 kv.

5. In a method of depositing liquid coating material on an article in a system in which coating material particles are formed from a thin stream of a liquid body by mechanical force derived from a stream of atomizing air, and in which the liquid body is electrically charged, the improvement comprising the step of adjusting the resistivity of the coating material to be between 0.3 and 300 megohm-centimeters and charging the liquid body to such voltage that at least 99 percent of the current carried to the article is borne by the charged coating material particles and not more than 1 percent of the current is air-borne.

6. The method of depositing liquid coating material on an article in accordance with claim 5 in which the resistivity of the coating material lies between 2.5 and 150 megohm-centimeters.

7. The method of depositing liquid coating material on a surface in accordance with claim 5 in which the voltage applied to the liquid body lies between 12 and 40 kilovolts.

8. A method of depositing liquid coating material on an article in a system in which coating material particles are formed from a thin stream of a liquid body by air atomization which comprises diffusing the atomizing airstream, adjusting the conductivity of the coating material to be between 0.3 and 300 megohm-centimeters and charging the liquid body to such voltage that at least 95 percent of the current carried to the article is borne by the charged coating material particles and not more than 5 percent of the current is air-borne.

9. A method of depositing liquid coating material, comprising selecting a coating material having an electrical conductivity between 0.3 and 300 megohm-centimeters, issuing the coating material into a space adjacent an article to be coated in the form of a thin stream, forming spray particles at a terminus of the thin stream of coating material by a flow of compressed air and applying voltage to the coating material of sufficient magnitude to concentrate electrical charge on the terminus of the thin stream and to charge the spray particles formed therefrom, but less than the voltage at which significant air ionization occurs adjacent the terminus.

10. The method set forth in claim 9 wherein the voltage applied to the coating material results in immeasurably low ionization current.

11. The method set forth in claim 9 wherein the voltage applied to the coating material is less than 40 kilovolts.

12. In a method of depositing liquid coating material on an article which includes the steps of applying high voltage to liquid coating material, issuing the liquid coating material as an electrically charged stream and subjecting the electrically charged stream to a flow of compressed air to form electrically charged spray particles, the improvement comprising adjusting the electrical conductivity of the coating material within the range of 0.3 to 300 megohm-centimeters and adjusting the voltage applied to said coating material to effectively charge the spray particles without the formation of significant air ionization by the electrically charged coating material.

13. The method set forth in claim 12 wherein the electrical conductivity of the coating material and the applied voltage are adjusted to give a specific particle charge in excess of one micro-coulomb per gram of liquid paint applied and immeasurably low air ionization current.

* * * * *